United States Patent [19]

Hevoyan

[11] Patent Number: 4,548,157

[45] Date of Patent: Oct. 22, 1985

[54] SANITARY SCHEDULING DEVICE FOR DISPENSER CLOSURES

[75] Inventor: Varoujan H. Hevoyan, Los Angeles, Calif.

[73] Assignee: Timothy L. Chrisman, Manhattan Beach, Calif.

[21] Appl. No.: 579,220

[22] Filed: Feb. 10, 1984

[51] Int. Cl.[4] ..... G09F 11/04; A61J 7/00

[52] U.S. Cl. ..... 116/308; 206/459; 206/534; 215/11 R

[58] Field of Search ..... 116/308; 215/11 R–11 E, 230, 365; 40/310, 311; 206/459, 534

[56] References Cited

U.S. PATENT DOCUMENTS

| | | | |
|---|---|---|---|
| 1,672,467 | 6/1928 | Oshman et al. | 215/11 R |
| 2,111,637 | 3/1938 | Mehaffey | 215/230 |
| 2,450,949 | 10/1948 | Gattuccio et al. | 116/308 |
| 2,648,226 | 8/1953 | Finch | 215/11 A |
| 2,746,631 | 5/1956 | Witz | 215/11 R |

*Primary Examiner*—Charles Frankfort
*Assistant Examiner*—W. Morris Worth
*Attorney, Agent, or Firm*—William H. Maxwell

[57] ABSTRACT

A time reminder device in a sanitary combination with a container for dispensing content in the form of pills or liquids, with or without a nipple projecting therethrough, and adjustable to a time index associated with a ring member snapped onto a cap or coupling and rotatably positioned by a detent.

13 Claims, 6 Drawing Figures

SANITARY SCHEDULING DEVICE FOR DISPENSER CLOSURES

BACKGROUND OF INVENTION

This invention relates to dispensing from a container on a time schedule and particularly the dispensing of liquids from bottles which require washing between use periods. It is the scheduled dispensing of bottled contents such as pills or liquids with which this invention is concerned. More particularly, milk and the like is to be dispensed from bottles on a time schedule which varies from time to time in the nursing of infants, and often results in going of schedule since the frequency in the hours of nursing are often difficult to maintain through the night, for example when there is a tendency for a person in nursing attendence to be sleepy and not altogether astute with respect to time and what should or should not be done. For example, when a baby sitter or hospital nurse is in attendance of a number of infants, the scheduling and individual feeding requirements of those many infants can become confusing. Also, elderly people have difficulty in remembering when to take prescribed medication. Therefore, it is a general object of this invention to provide a time reminder device incorporated in the cap of a bottle for taking pills and the like, and in the coupling of a bottle for feeding milk and the like.

Caps and couplings for the open ends of containers are subject to contamination when used for dispensing medicinal pills and especially when dispensing liquids used for feeding infants, and all of which requires repeated cleaning in order to maintain sanitary conditions. Heretofore mechanical means incorporated in medicine bottle caps for recording time schedules have been complicated by means which cannot be cleaned satisfactorily. That is, openings, corners, crevases and interstices are present which make it virtually impossible to maintain absolute cleanliness. Accordingly, it is an object of this invention to provide a time reminder device in the cap or coupling of a dispensing container or bottle which is devoid of openings, corners, crevases or interstices which are known to collect contaminating debris and foreign matter. With the present invention, the cap or coupling with its time reminder device involves but two parts which snap together and apart with facility through obvious manipulation.

Nursing bottles are characterized by a screw-on coupling that secures a rubber nipple that projects through a top opening with a flange of the nipple acting as a seal between the coupling and bottle neck or opening. The time remainder device of this invention is embodied in a ring that snaps onto and off of the coupling crown where it is calibrated according to the time related to an index position. The parts and elements are simple and inexpensive of manufacture and do not interfere with sanitation in any way, and all parts are readily cleaned in the manner that nursing bottles and nipples and couplings are presently cleaned.

SUMMARY OF INVENTION

The dispensing of medicines and the feeding of infants is done on a time basis, involving the scheduled use of pills from a bottle in the case of medicines, and involving the scheduled use or feeding of liquids in the case of nursing infants. The closure of a medicine bottle is usually by means of a cap, while the closure of a nursing bottle is by means of a coupling for the attachment of a nipple. In both the cap and coupling forms of closure, sanitation is a prerequisite, so that any mechanical device in addition thereto must also qualify with respect to sanitation. Accordingly, the time reminder device of the present invention qualifies with respect to sanitation in that it is a simple removable part, separable from the coupling and which can be sterilized along with the separated coupling, nipple and bottle. Like the nipple and coupling assembly, the time reminder device is snapped into and out of working position with facility. The pill bottle embodiment is also snapped together, but without the projection of a nipple therethrough.

The foregoing and various other objects and features of this invention will be apparent and fully understood from the following detailed description of the typical preferred forms and applications thereof, throughout which description reference is made to the accompanying drawings.

THE DRAWINGS

PREFERRED EMBODIMENT

Figure 1:
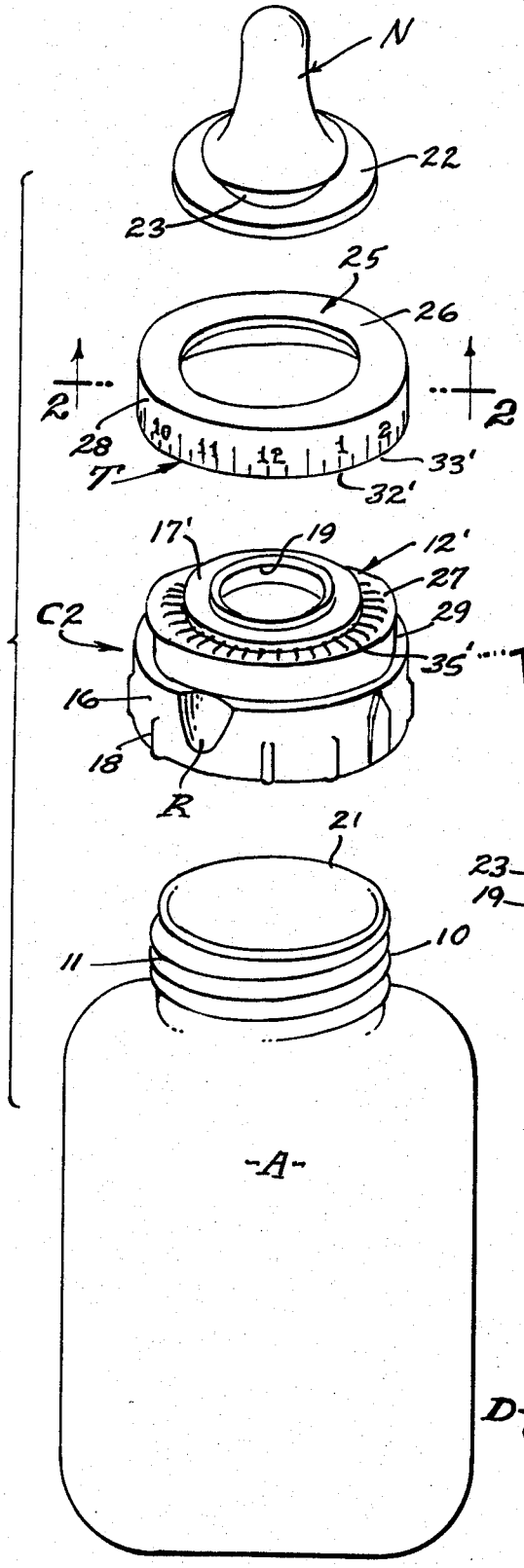
FIG. 1 is an exploded view of the preferred form of this invention, showing the elements thereof separated as they would be for cleaning and/or sterilization.
Figure 2:
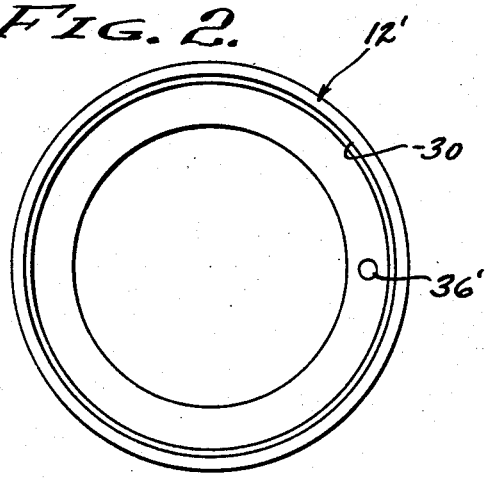
FIG. 2 is an enlarged view taken as indicated by line 2—2 on FIG. 1.

Pill bottles and nursing bottles are both relatively wide mouthed containers, adapted for access to the contents and for easy cleaning. Such a bottle can vary widely in its configuration and is characteristically a vessel A having a bottom, side walls, and a convergent top opening neck 10 with coupling means usually in the form of threads 11 for receiving a screw-on cap C1 or coupling C2. A simple screw-on cap C1 is most often employed as the closure for pill bottles, while an apertured screw-on coupling C2 is employed as the closure for nursing bottles. Cap C1 features an imperforate crown member 12 while coupling C2 features an apertured crown member 12'. Both the cap and coupling C1 and C2 include anchor means B for the releasable snap-on reception of the time reminder device T of the present invention.

The cap C1 and coupling C2 are basically alike and each includes a circular crown with a depending skirt 16 having an interior with threads 15 engageable with threads 11 on the bottle neck 10. Grip ribs 18 are provided on the cylindrical exterior of the skirt 16 for manual gripped engagement and turning of the cap-coupling. In the case of the cap C1 the crown member 12 is an imperforate disc 17 integral with skirt 16. In the case of the coupling C2 the crown member 12' is an apertured disc 17' integral with skirt 16 and having a concentric opening 19 therethrough for passage of nipple N. As shown, the interior of the disc 17' presents a wide shoulder 20 opposed to the top end 21 of the bottle neck for capture of a nipple flange 22 therebetween.

The nipple N is a rubber or elastomer part of considerable elasticity, so as to be pulled into and out of snapped engagement through the opening 19, having an outside groove 23 receiving the disc opening with the underlying flange 22 compressed and captured as above described. The nipple N is thereby sealed with the neck 10 of the bottle and is separable from the coupling C2 when removed from the bottle, all in the usual manner.

In accordance with this invention I provide the time reminder device T and anchor means B for its snap-on rotatable engagement with the cap C1 or coupling C2, as the case may be. Accordingly, the crown members 12 and 12' have a recessed periphery adapted to receive a ring-shaped member 25 flush with the exterior of both the top of the crown 12 and 12' and outside of a skirt 16. The peripheral cross section of the member 25 is comprised of an inturned flange 26 occupying a step 27 in the top of the crown, and of a downturned rim 28 occupying a step 29 in the periphery of the crown.

Figure 3:
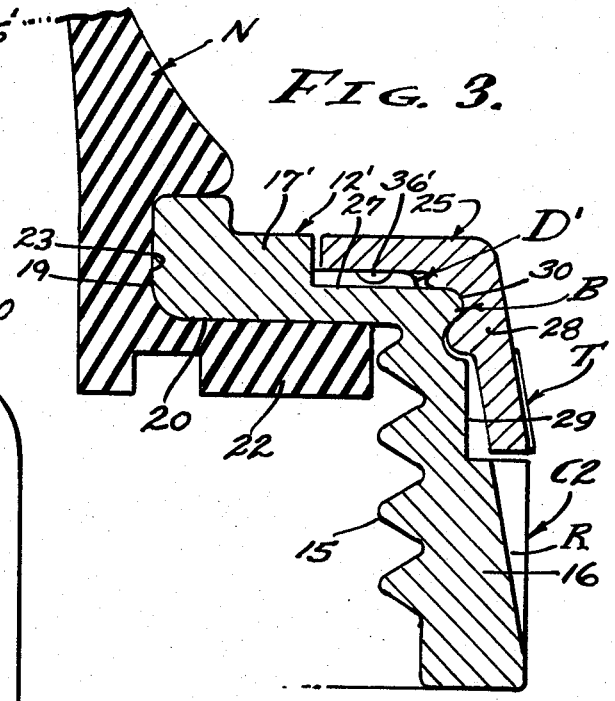
FIG. 3 is an enlarged fragmentary sectional view through the crown portion of the coupling-timer-nipple assembly.
Figure 4:
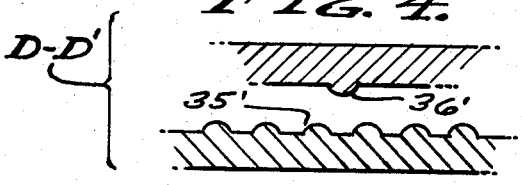
FIG. 4 is a sectional view of the detent elements (separated for clarity).

The anchor means B is comprised of a peripheral rib 30 at the joinder of the steps 27 and 29, a peripheral rib that projects radially for the snap-on engagement of a complementary matching circular groove 31 at the joinder of flange 26 and rim 28 of member 25. Skirt 16 of cap C1 and coupling C2 is provided with an accessible bevel or recess R as shown in FIGS. 1 and 3, by which said member can be lifted for removal. The wall thickness of member 25 is substantially less than that of the cap C1 or coupling C2, and being somewhat resilient and of lighter cross section is adapted to expand and thereby spring into and out of rotatable working position when manually removed and reapplied.

Figure 5:
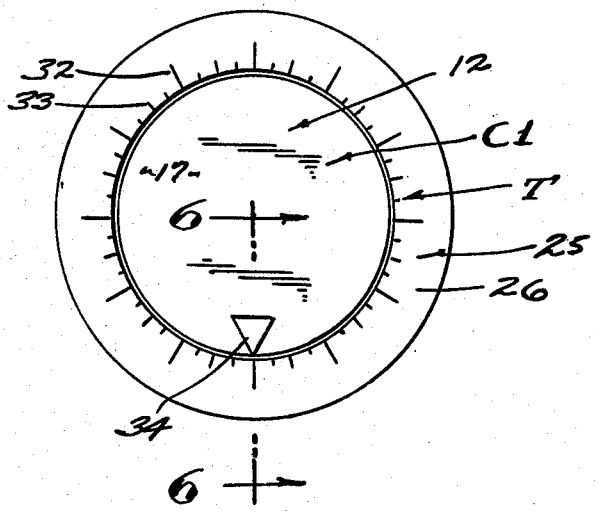
FIG. 5 is a top plan view of the second embodiment with the time reminder indicia on the crown of the assembly.
Figure 6:
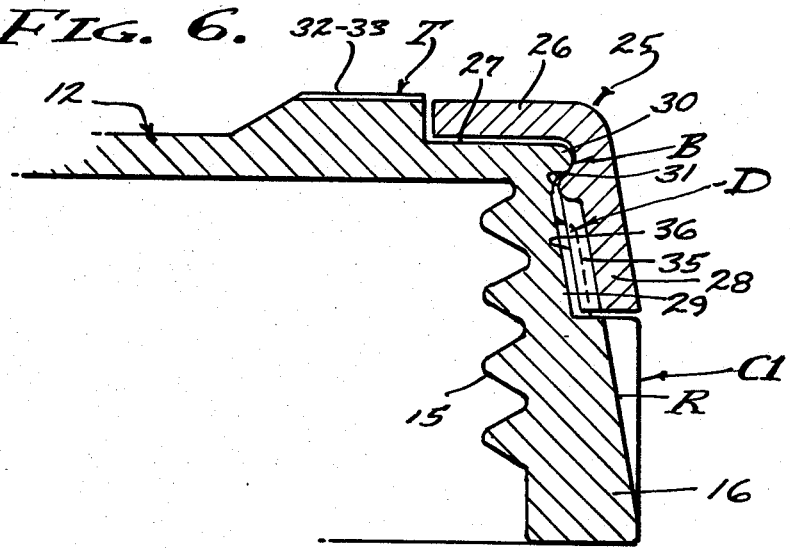
FIG. 6 is a view similar to FIG. 3 and taken as indicated by line 6—6 on FIG. 5.

In the preferred embodiment of FIGS. 5 and 6, the closure cap C1 has an imperforate disc 17 and the ring member 25 is free to rotate on the retaining anchor rib 30. In accordance with this invention, the exterior of the member 25 is calibrated into twelve major numbered marks 32 to represent hours of the day, and with three intermediate minor marks 33 (four intervals) therebetween representing fifteen-minute intervals. As shown in this first form of the invention, the marks 32 and 33 are equally spaced and embossed on the top of flange 26, there being a single index pointer 34 embossed on the top of disc 17 to register with any one of said marks 32 and 33. Registration of the pointer 34 with marks 32 and 33 is related to time, so that scheduling can be by the hour and quarter hour as circumstances require.

Registration in the above described first embodiment is by detent means D comprised of a circumferential series of equally spaced indentations on one part of the time remainder means T to receive a single projection on the other part thereof. There is one indentation for each time increment or mark. As shown, there are forty-eight indentations 35 on the outside of the step 29 of the skirt 16 of the crown member 12, and a single projection 36 on the inside of rim 28 of member 25. There is radial interference between projection 36 and the indentations 35, and the member 25 being somewhat resilient and of lighter cross section than the crown member 12 of cap C1, is adapted to spring into and out of selected hour and quarter hour positions.

In the second and preferred embodiment of FIGS. 1 through 4, the closure C2 has a perforated disc 17' for reception of the nipple N, and the ring member 25 is free to rotate on the retaining anchor rib 30. In accordance with this invention, the exterior of the member 25 is calibrated into twelve major numbered marks 32' to represent hours of the day, and with three intermediate minor marks 33' (four intervals) therebetween representing fifteen-minute intervals. As shown in this second form of the invention, the marks 32' and 33' are equally spaced and embossed on the outside of rim 28, there being a single index pointer 34' embossed on the skirt 16 to register with any one of said marks 32' and 33'. Registration of the pointer 34' with marks 32' and 33' is related to time, so that scheduling can be by the hour and quarter hour as circumstances require.

Registration in the above described second embodiment is by detent means D' comprised of a circumferential series of equally spaced indentations on one part of the time reminder means T to receive a single projection on the other part thereof. As shown, there are forty-eight indentations 35' on the top of the step 27 of the crown member 12', and a single projection 36' on the underside of the flange 26. There is axial interference between projection 36' and the indentations 35', and the member 25 being somewhat resilient and of lighter cross section than the crown member 12' of cap C2 is adapted to spring into and out of selected hour and quarter hour positions.

Having described only the typical preferred forms and applications of my invention, I do not wish to be limited or restricted to the specific details herein set forth, but wish to reserve to myself any modifications or variations that may appear to those skilled in the art as set forth within the limits of the following claims.

I claim:

1. A time reminder device for a closure of a container and including, a crown member with a top step adjoining a peripheral step, a rotatably positionable ring member having an inturned flange occupying said top step and a downturned rim occupying said peripheral step, anchor means releasably securing the ring member to the crown member, equally spaced time marks on one of said members and an index mark on the other member, and detent means comprised of indentations in one of said members equal in number to said spaced time marks and a projection on the other member to engage individually therein, at least one member being resilient to permit selected positioning of said rotatably positionable ring member.

2. The time reminder device for the closure of a container as set forth in claim 1, wherein the closure has a depending skirt for threaded engagement onto a neck of the container.

3. The time reminder device for the closure of a container as set forth in claim 1, wherein the anchor means comprises a peripheral rib at the joinder of the steps of the crown member and a circular groove at a joinder of the flange and rim of the ring member, said rib and groove being releasible by means of said resiliency in the at least one member.

4. The time reminder device for the closure of a container as set forth in claim 1, wherein the equally spaced time marks are on the rim of the rotatable ring member and the index mark is on a skirt depending from the crown member.

5. The time riminder device for the closure of a container as set forth in claim 1, wherein the equally spaced time marks are on the top of the flange of the rotatable ring member and the index mark on a top of the crown member.

6. The time reminder device for the closure of a container as set forth in claim 1, wherein the detent means comprises a plurality of indentations in the peripheral step of the crown member and an engageable projection inside the rim of the ring member.

7. The time reminder device for the closure of a container as set forth in claim 1, wherein the detent means comprises a plurality of indentations in the top step of the crown member and an engageable projection on the flange of the ring member.

8. The time reminder device for the closure of a container as set forth in claim 1, wherein the crown member of the closure is imperforate for containing content.

9. The time reminder device for the closure of a container as set forth in claim 1, wherein the crown member of the closure is imperforate for containing content, wherein the closure has a depending skirt for threaded engagement onto a neck of the container, wherein the anchor means comprises a peripheral rib at the joinder of the steps of the crown member and a circular groove at a joinder of the flange and rim of the ring member, said rib and groove being releasible by means of said resiliency in the at least one member.

10. The time reminder device for the closure of a container as set forth in claim 1, wherein the crown member of the closure is imperforate for containing content, wherein the closure has a depending skirt for threaded engagement onto a neck of the container, wherein the anchor means comprises a peripheral ring at the joinder of the steps of the crown member and a circular groove at a joinder of the flange and rim of the ring member, said rib and groove being releasible by means of said resiliency in the at least one member, wherein the equally spaced time marks are on the top of the flange of the rotatable ring member and the index mark on the top of the crown member, and wherein the detent means comprises a plurality of indentations in the peripheral step of the crown member and an engageable projection inside the rim of the ring member.

11. The time reminder device for the closure of a container as set forth in claim 1, wherein the crown member of the closure is perforate with an opening for releasible reception of an elastic nipple for dispensing liquid content.

12. The time reminder device for the closure of a container as set forth in claim 1, wherein the crown member of the closure is perforate with an opening for releasible reception of an elastic nipple for dispensing liquid content within said container, wherein the closure has a depending skirt for threaded engagement onto a neck of the container, wherein the anchor means comprises a peripheral rib at the joinder of the steps of the crown member and a circular groove at a joinder of the flange and rim of the ring member, said rib and groove being releasible by means of said resiliency in the at least one member.

13. The time reminder device for the closure of a container as set forth in claim 1, wherein the crown member of the closure is perforate with an opening for releasible reception of an elastic nipple for dispensing liquid content, wherein the closure has a depending skirt for threaded engagement onto a neck of the container, wherein the anchor means comprises a peripheral rib at the joinder of the steps of the crown member and a circular groove at a joinder of the flange and rim of the ring member, said rib and groove being releasible by means of said resiliency in the at least one member, wherein the equally spaced time marks are on the rim of the rotatable ring member and the index mark is on a skirt depending from the crown member, and wherein the anchor means comprises a plurality of indentations in the top step of the crown member and a engageable projection on the flange of the ring member.

* * * * *